US007659876B2

(12) United States Patent
Stessen et al.

(10) Patent No.: US 7,659,876 B2
(45) Date of Patent: Feb. 9, 2010

(54) DRIVING A DISPLAY WITH A POLARITY INVERSION PATTERN

(75) Inventors: Jeroen Hubert Christoffel Jacobus Stessen, Eindhoven (NL); Aleksandar Sevo, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 548 days.

(21) Appl. No.: 11/572,575

(22) PCT Filed: Jul. 21, 2005

(86) PCT No.: PCT/IB2005/052459

§ 371 (c)(1),
(2), (4) Date: Jan. 24, 2007

(87) PCT Pub. No.: WO2006/013525

PCT Pub. Date: Feb. 9, 2006

(65) Prior Publication Data

US 2008/0094383 A1 Apr. 24, 2008

(30) Foreign Application Priority Data

Jul. 29, 2004 (EP) ..... 04103667

(51) Int. Cl.
*G09G 3/36* (2006.01)

(52) U.S. Cl. ..... 345/96; 345/54; 345/209; 345/690; 348/447; 349/37

(58) Field of Classification Search ..... 345/54, 345/58, 77, 79, 96, 102, 209, 690; 348/447, 348/615, 792; 349/37
See application file for complete search history.

(56) References Cited

U.S. PATENT DOCUMENTS

| | | | | |
|---|---|---|---|---|
| 5,365,284 | A | 11/1994 | Matsumoto et al. | |
| 5,790,092 | A * | 8/1998 | Moriyama | 345/96 |
| 5,861,863 | A * | 1/1999 | Kudo et al. | 345/100 |
| 6,469,684 | B1 | 10/2002 | Cole | |
| 7,050,031 | B2 * | 5/2006 | Saishu et al. | 345/96 |
| 7,053,876 | B2 * | 5/2006 | Kimura et al. | 345/98 |
| 7,119,780 | B2 * | 10/2006 | Saishu et al. | 345/96 |
| 7,180,488 | B2 * | 2/2007 | Hirakata | 345/87 |
| 2003/0201959 | A1 | 10/2003 | Sakaguchi | |

* cited by examiner

*Primary Examiner*—Henry N Tran

(57) ABSTRACT

This invention relates to a method for driving a display panel (DP) having pixels (P). The display panel (DP) is driven with a sequence of image frames. The image frames are converted to a drive signal (V2) comprising refresh frames with a refresh frame period (TR) shorter than the image frame period. A pixel (P) of the display panel (DP) is driven with an adapted drive signal having a first polarity during a first group of refresh frame periods, and having a reversed polarity during a subsequent second group of refresh frame periods. The first group and the second group each comprise at least two refresh frame periods.

13 Claims, 7 Drawing Sheets

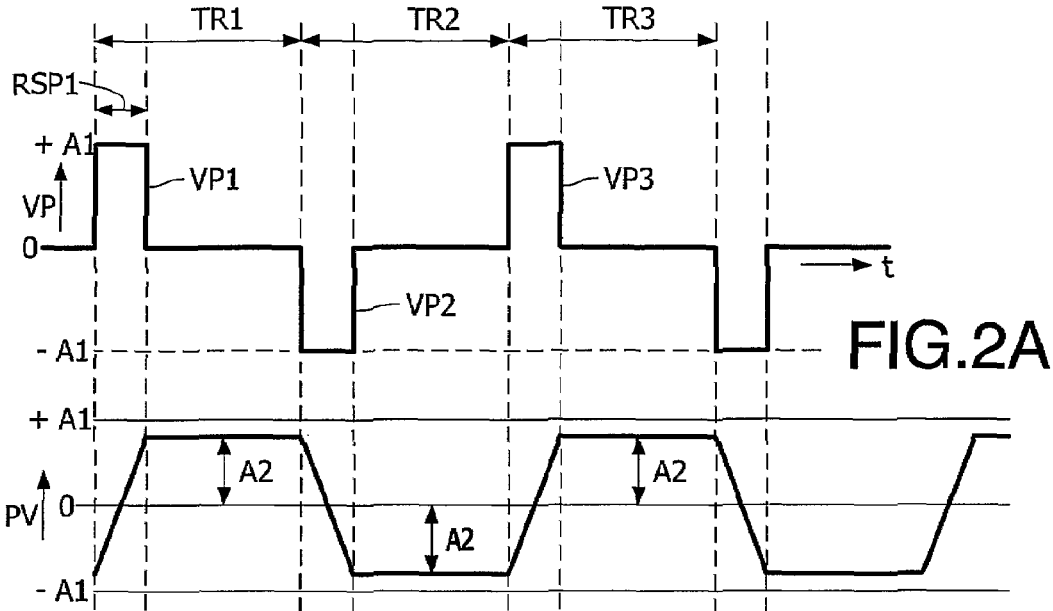
FIG.2A
FIG.2B
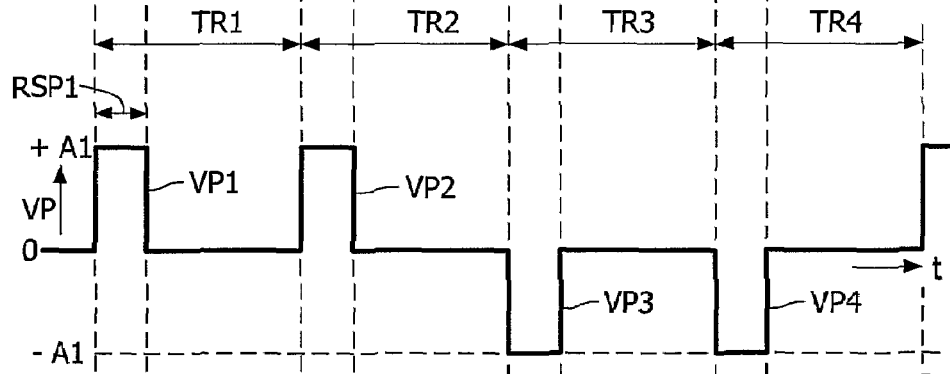
FIG.2C
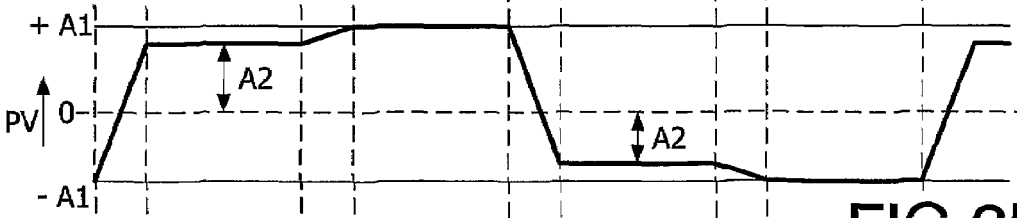
FIG.2D
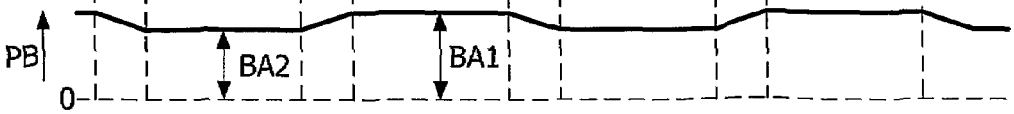
FIG.2E

TR1
TR2
TR3
TR4
TR5
V2
A1
B1
0

+ A1
VP
0
- B1
VP1
VP2
VP3
VP4
VP5
t

+ A1
DC
PV
0
- B1

+ A1
+ B1
VP
0
- B1
- A1
VP1
VP2
VP3
VP4
VP5
t

A1
B1
PV
0
- B1
- A1

PB
0
BA1
BB1

TR1
TR2
TR3
TR4
TR5
V2
A1
B1
0
t

25%
5%
0%
LP
0

50%
25%
LP
0

100%
50%
100%
50%
LP
0

DRIVING A DISPLAY WITH A POLARITY INVERSION PATTERN

FIELD OF INVENTION

This invention relates to driving a display panel having pixels with a polarity inversion scheme.

BACKGROUND OF INVENTION

An active matrix device, such as described in U.S. Pat. No. 6,469,684, comprises an inversion circuitry coupled to drive signals, which inversion circuitry has at least one Cole sequence generator providing random, semi-random, or pseudo-random sequence patterns of the matrix. The Cole sequence generator provides a sequence of inversion patterns of pixel biasing over several frames. Over time each pixel is presented with a substantially equal number of positive and negative drive levels to prevent the generation of undesirable display artifacts, such as image retention or image sticking, that might occur under a direct current bias without inversion.

Generally for television applications, this pixel biasing inversion is carried out once per frame, that is, with a frequency equal to a display refresh rate and synchronous with a video signal. For the reduction of motion artifacts, often a scanning backlight is applied as light source for a liquid crystal display panel. The light of lamps of the scanning backlight is generally emitted in the form of light pulses. If the repetition rate of these pulses is rather low, for example in the order of 50 to 60 Hz, an undesirable flicker is visible due to these light pulses. The inventors have observed that, when increasing the display frame rate to solve this problem, other artifacts deteriorate the quality of the images displayed on the display panel.

SUMMARY OF THE INVENTION

It is an object of the present invention to reduce one or more of the above-mentioned artifacts. The invention is defined by the independent claims. The dependent claims define advantageous embodiments.

Selecting a display refresh rate higher than the image frame rate reduces the flicker. When doing this and applying a conventional polarity inversion scheme by inverting the polarity of the drive levels of a pixel for each subsequent display frame, a problem arises due to the incomplete charging of the display pixels. The parasitic resistances of the driver circuits and of electrodes coupling the driver circuits to the pixels, in combination with parasitic capacitances of the electrodes and pixels, form a low pass filter. When a driver circuit generates a voltage pulse, the resulting response at the pixel is a gradually rising (or decreasing) voltage. Within the short period available to address a pixel the gradually rising voltage does not reach its final value. This effect is called the incomplete charging of the display pixels. When the display refresh rate is increased, the time to address a pixel is reduced. Hence, the gradually rising voltage at the display pixel is even further removed from its final value at the end of the pixel address period. When applying polarity inversion for each subsequent frame period, it means that the voltage at the pixel for each subsequent frame has to change polarity. So each frame period a large voltage swing is required, which means that the final value cannot be reached within any addressing period due to the incomplete charging of the pixel. This is also the case, if the image to be displayed does not change over time. Moreover, each of the pixels may have slightly different parasitic parameters, resulting in a non-uniform image reproduction, because the pixels do not all reach a same value during the addressing period even when the voltage pulses have the same amplitude for all pixels.

By keeping, for example, the polarity during two refresh frame periods the same and then reversing the polarity during the next two display frame periods, the voltage at the pixel may reach approximately its final value during the second refresh frame period of the same polarity, as during this second period the remaining voltage difference between the drive pulse of the driver circuit and the gradually rising voltage at the pixel is much smaller. Moreover, the sequence of two refresh frame periods with a first polarity followed by two refresh frame periods with a reversed polarity, results in an average voltage of zero volts across the pixel when averaged over these two plus two frame periods, provided the image frames are substantially the same during this period.

So, by increasing the refresh rate, a reduction of flicker has been achieved, while the non-uniformity caused by the incomplete charging of the pixels at this higher refresh rate has been reduced by an adapted polarity inversion scheme.

The display panel may be any type of display panel having artifacts due to a DC-component and incomplete charging of the pixels, such as a Liquid Crystal Display, hereinafter also called LCD, panel. In case of an LCD type of display panel, it may be any type of LCD display panel such as used in direct view displays, front projection, or rear projection displays. Moreover, it may be a transmissive LCD, a reflective LCD, or a combination of both.

It is advantageous, if the first group of refresh frame periods comprises a first and a second refresh frame, and the method comprises selecting as the second refresh frame a refresh frame, which is obtained by using data at least partially obtained by converting from an image frame which is different from the image frame of which the first refresh frame is obtained. If the sequence of image frames is formed by interlaced images, so alternating odd and even fields, then as part of the conversion de-interlacing is required. If this de-interlacing is not done correctly, some differences in voltage levels between drive signals obtained for odd and even frames, respectively, may be present. If the polarity inversion would take place in a way that, for example, two subsequent drive frames substantially converted from an odd frame are driven during the first group of two refresh periods with the first polarity, followed by two subsequent drive frames substantially converted from an even frame and driven during the second group of two refresh periods with the reversed polarity, then the two first drive frames during the first group of refresh periods may result in an average voltage across the pixel which is different from the average voltage during the second group of refresh periods. This difference is caused by the incorrect de-interlacing. The result of this difference is that the average voltage across the pixel during the sum of the first and the second group of refresh periods has a DC component, which is undesirable. By selecting as the second refresh frame a refresh frame, which is obtained by using data obtained by converting from an image frame which is different from the image frame of which the first refresh frame is obtained, it is avoided that a DC-component is built up for such incorrectly de-interlaced image frames.

In an embodiment the display panel is adapted for modulating light originating from a light source, which is capable of providing a light pulse with a duration of a fraction of the refresh frame period, and the method further comprises varying the duration and/or an amplitude of the light pulse in dependence on ambient conditions of the display panel and/or a content of the image frames. Using again the example of the LCD display panel, the pixels of the panel modulate the light originating from the light source. This light source, which in the case of a direct view transmissive LCD is also called a backlight, may comprise one or more lamps which sequentially are turned on, whereby each lamp provides light in the form of light pulses to corresponding pixels of the display panel. This so-called scanning backlight has the advantage that artifacts, which are caused by displaying moving images on a display panel having a sample and hold behavior, are reduced.

To obtain an adequate motion portrayal, a light pulse should preferably be present during a fraction of the refresh frame period. This has the advantage that such a pulse may be repeated every refresh frame period, which means that this pulse is repeated at the refresh rate (being one divided by the refresh frame period), which is higher that the image frame rate (being one divided by the image frame period). This higher rate has the advantage that visibility of flicker caused by repeating light pulses is reduced. The amount of light provided by the light pulses may be varied by varying the duration and/or the amplitude of subsequent pulses. For example, depending on ambient light conditions the brightness of the display panel may be varied by varying the amount of light provided by the light pulses to adjust the displayed image to the ambient light conditions. The amount of light provided by the light pulses also may be varied in dependence on the content of the image, for example, in dependence on the brightness of the image frames or in dependence on whether the image frames contain moving images. So, by the varying of the amount of light, the displayed images may be optimized in dependence on the content of the image frames.

It is advantageous, if the light source is capable to provide at least a first light pulse and a second light pulse during the image frame period, and if the method further comprises varying the duration and/or the amplitude of one of the first and the second light pulses. By providing the first and the second light pulse during the image frame period, for example by providing the first light pulse during a first refresh frame period and the second light pulse during a second refresh frame period, a high pulse rate is obtained. At the same time, by varying only the amount of light of one of the first and the second pulses, it is possible to further reduce artifacts of the images to be displayed, for example, by selecting for the refresh frame, which matches closest with a corresponding image frame, the light pulse, which provides the largest amount of light. This is especially relevant if a first refresh frame is obtained during conversion directly from the image frame, while a second refresh frame is obtained during conversion by interpolation between several image frames. In this case, it is advantageous if the first refresh frame receives the largest amount of light.

It is advantageous, if the method further comprises varying the duration and/or the amplitude of the first light pulse during the image frame period, if the duration and/or the amplitude of the second light pulse has a minimum value. As mentioned in the above example, the first refresh frame receiving the first light pulse should preferably receive the largest amount of light compared to the second refresh frame. So, the duration and/or the amplitude of the first light pulse should be relatively large compared to the duration and/or the amplitude of the second light pulse. As long as the amount of light to be supplied is relatively low (in the order of 25% to 50% of the maximum possible level), preferably, the duration and/or amplitude of second light pulse should be kept at a minimum value, while the first light pulse is varied in dependence on the required amount of light. The minimum value may be a predetermined minimum value or zero.

The method may further comprise selecting as the first light pulse a light pulse substantially coinciding with a refresh frame period within the image frame period, which refresh frame period provides the best reproduction of the image frame on the display panel. For example, a refresh frame period may be selected which corresponds with the refresh frame, which matches closest with a corresponding image frame, rather than a refresh frame which corresponds to an interpolation of several image frames. As another example, a refresh frame period may be selected which results in the lowest possible artifacts, for example which results in a minimum visibility of motion artifacts.

The method may further comprise varying the duration and/or the amplitude of the first light pulse if the light source has to deliver a brightness below a first predetermined value; varying the duration and/or the amplitude of the second light pulse if the light source has to deliver a brightness between the first predetermined value and a second predetermined value larger than the first predetermined value; and varying the duration and/or the amplitude of the first and the second light pulses if the light source has to deliver a brightness above the second predetermined value.

So, if the light source has to deliver a brightness above the second predetermined value both the first and the second light pulses are varied. At this relatively high brightness level flicker due to the light pulses may become visible. However, the relatively high repetition rate of the pulses due to the presence of both pulses makes the flicker less visible.

At a brightness between the first predetermined value and the second predetermined value the brightness level the duration and/or the amplitude of the second light pulse is varied. So, this allows to firstly reducing the duration and/or the amplitude of the second light pulse, while keeping the duration and/or the amplitude of the first light pulse at a relatively high value. This implies that the refresh frame period, which provides the best reproduction, receives the highest amount of light, while another refresh frame period receives a lower amount of light depending on the actual amount of brightness to be delivered. Again, this results in a reduction of visible artifacts.

If the light source has to deliver a brightness below the first predetermined value, so a relatively low value, the duration and/or the amplitude of the first light pulse is varied. At these low brightness values the second light pulse has a relatively small duration and/or amplitude, or the duration and/or amplitude may even be zero. If the duration and/or amplitude is zero, only the first light pulse is present. This means that the repetition rate is now halved compared to the situation at the relatively high brightness level, where both the first and the second light pulses are present. However, as the brightness level is now relatively low, flicker due to the relatively low repetition rate is less visible.

By varying the duration and/or the amplitude of the first and the second pulses in different ways in dependence on the brightness level to be delivered as described above, it is possible to further reduce artifacts, while allowing at the same time to exploit the maximum available light output of the light source.

The driving circuitry may be formed by an integrated circuit, or by a group of integrated circuits, which may have peripheral components.

The display product may be a television receiver, a monitor, a projector, or any other product with a display device. The signal processing circuitry converts an external input signal, for example, a video signal received from an antenna or from an external input device such as a DVD-player or computer coupled to the product, into a format suitable as input signal for the display device.

These and other aspects of the present invention are apparent from and will be elucidated with reference to the embodiments described hereinafter.

BRIEF DESCRIPTION OF THE DRAWINGS

The invention is described further by way of example only with reference to the appended drawings, wherein:

FIGS. 2A and 2B show graphs of voltage pulses and a resulting pixel voltage for a particular polarity inversion scheme;

FIGS. 2C to 2E show graphs of voltage pulses, a resulting pixel voltage, and the pixel brightness for a polarity inversion scheme according to a first embodiment of the present invention;

DETAILED DESCRIPTION OF PREFERRED EMBODIMENTS

Figure 1A:
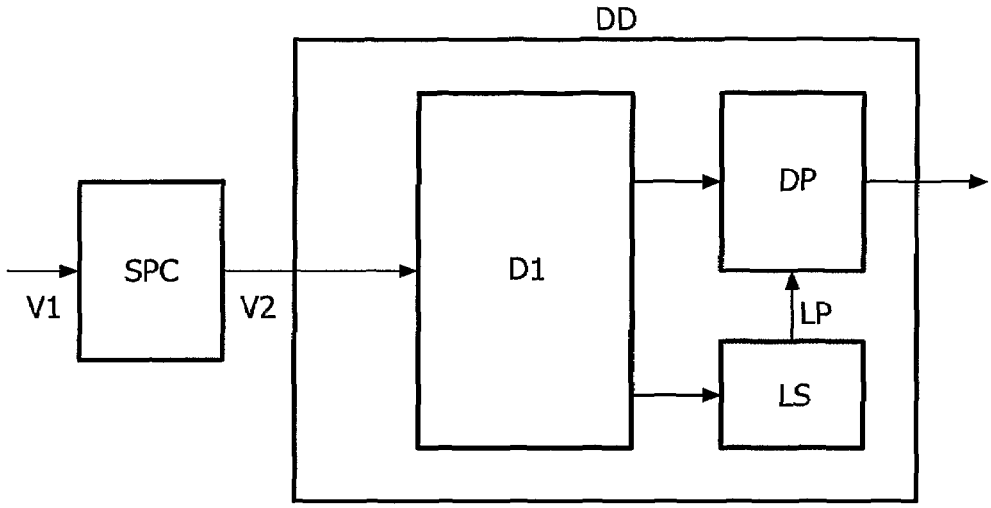
FIG. 1A shows a display product according to the invention.

The same reference numerals used in different Figs. refer to the same or similar elements. FIG. 1A shows a display product. It comprises signal processing circuitry SPC, and a display device DD. The display device DD comprises driving circuitry D1, a display panel DP and a light source LS for generating light pulses LP. The signal processing circuitry SPC has an input for receiving an input signal V1, for example a video signal, from an external device coupled to an external input connector of the display product or from an antenna input or a connection to a network. The signal processing circuitry SPC is adapted to convert the input signal V1 into a drive signal V2 for driving the driving circuitry D1. The driving circuitry D1 is coupled to the display panel DP. The display panel DP displays a sequence of images in response to an adapted drive signal derived from the drive signal V2.

If the display panel DP is of a type which modulates light from a light source, such as a Liquid Crystal Display, hereinafter also called LCD, then a light source LS is present. This light source LS may provide a constant amount of light to the display panel DP. Alternatively, the amount of light provided may vary in dependence on, for example, the content of the images to be displayed. It the latter case, the driving circuitry D1 is also coupled to the light source LS to enable the control of the amount of light provided by the light source LS.

For simplicity of the explanation, it is assumed that all of the driving circuitry D1 is comprised in the display device DD as shown in FIG. 1A. However, it is also possible, that part of the driving circuitry D1 is included in the signal processing circuitry SPC. Moreover, whenever driving circuitry is mentioned, it is meant to include any combination of hardware and/or software that provides the features as explained below.

Figure 1B:
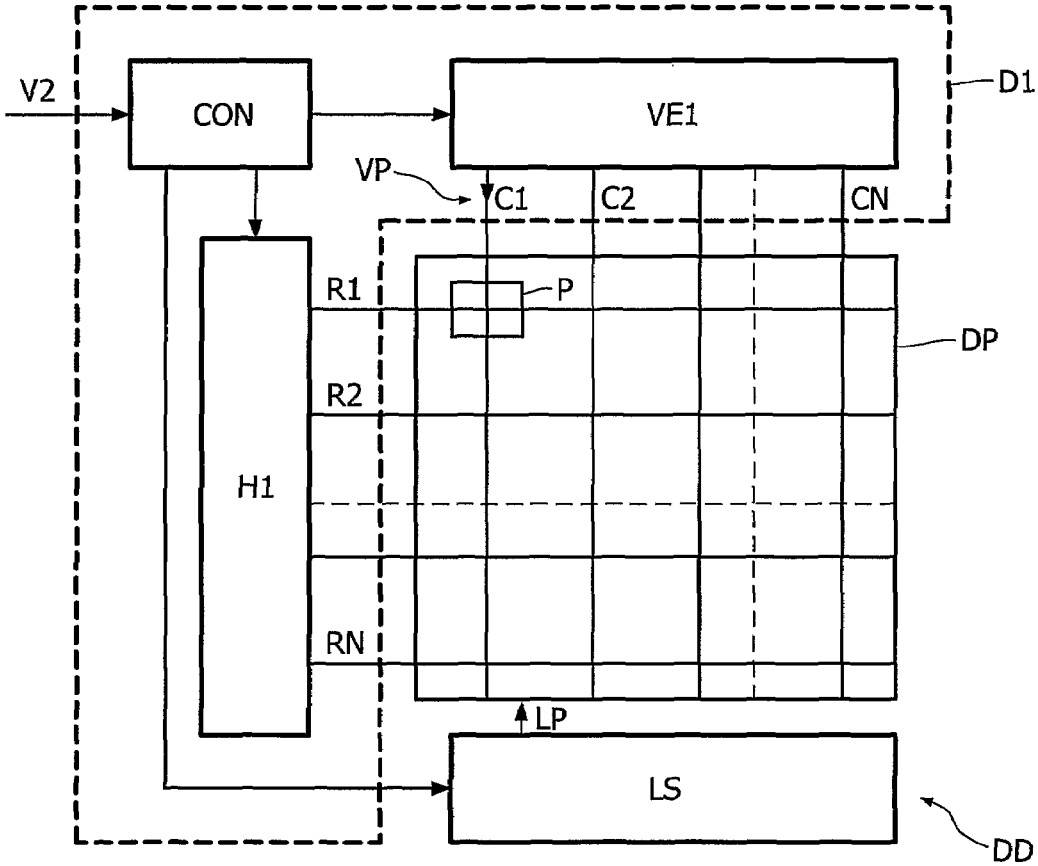
FIG. 1B shows an embodiment of a display device.

FIG. 1B shows an embodiment of a display device DD. The display panel DP is a matrix display panel with row electrodes R1, R2, . . . RN and column electrodes C1, C2 . . . CN. At each crossing of a row electrode and a column electrode a pixel P is present, as is shown for row electrode R1 and column electrode C1. The driving circuitry D1 comprises a controller CON that may comprise hardware and software for providing control signals to a vertical driver VE1, a horizontal driver H1, and the light source LS. In case of an active matrix display panel the pixel P comprises one or more active components, for example a transistor. Terminals of this transistor are coupled to the corresponding row and column electrode of the display panel DP.

If a sequence of images has to be displayed, each image is to be displayed during a frame period. Within a frame period sequentially the row electrodes are selected, while during a selection period of a particular row electrode, a voltage pulse VP is provided at each of the column electrodes by the vertical driver VE1. The amplitude of each of the voltage pulses VP corresponds to the amount of modulation of the light of the light source LS that has to be provided by the corresponding pixels P coupled to the selected row electrode. For example, in case of a transmissive LCD, the voltage pulse VP controls the percentage of light to be transmitted via the pixel P. The one or more active components of the pixel P receive this voltage pulse VP during the relatively short selection period of the concerned row electrode and maintain during the remainder of the frame period the value of the received voltage pulse as present at the end of the selection period. This means the pixel behaves as a "sample and hold" circuit.

As a result of the sample and hold behavior, moving images are not reproduced correctly on the display device DD, but appear blurred. This problem may be reduced by applying as a light source LS a so-called scanning backlight of which the lamps provide light pulses LP during a part of the frame period. Usually the lamps provide these light pulses LP sequentially. The duty cycle of these light pulses LP should preferably be in the order of 25% when the frame rate, being one divided by the frame period, is in the order of 50 to 60 Hz. However, such light pulses LP introduce the problem of flicker.

To reduce this flicker effect, the refresh frame rate, being the rate at which a pixel P of the display panel DP is being provided with subsequent voltage pulses VP, has to increase, for example from 50 Hz to 60, 75 or 100 Hz. However, an increase of the refresh frame rate introduces another problem. The voltage pulses VP have to be provided to the pixel P via the column electrodes (and/or row electrodes). Any resistance of the electrodes in combination with parasitic capacitance of the electrodes and/or pixel form a low pass filter for the voltage pulses VP. A pixel voltage PV resulting from a voltage pulse VP may therefore not have reached the level of the amplitude of the voltage pulse VP as provided by the vertical driver VE1 before the end of the selection period wherein the concerned row electrode is selected. This effect becomes even worse if the selection period available to select a row electrode is reduced due to the increased refresh frame rate.

On top of above mentioned problem, to avoid that a DC voltage is built up in the pixel P, the polarity of the voltage pulses VP has to be inverted regularly. Usually this polarity inversion is done by inverting the polarity of the voltage pulses VP supplied to a pixel P for each subsequent refresh frame period. This implies that in subsequent refresh frames the pixel voltage PV has to change from a positive to a negative value or vice versa, even if there is no change of the image in subsequent refresh frame periods. So, there is no opportunity to allow the pixel voltage PV to reach its final value in subsequent frame periods.

This effect is illustrated in FIGS. 2A and 2B. FIG. 2A shows an example of voltage pulses VP versus time t having a polarity inversion scheme which alternates in subsequent refresh frame periods. This scheme may be realized by hardware, for example included in the vertical driver VE1 or in the controller CON. Alternatively, this scheme may be realized using software, for example being present in the controller CON or the vertical driver VE1 or in circuitry preceding the controller CON. The subsequent refresh frame periods are indicated with TR1, TR2, and TR3, respectively. In this example the voltages pulses VP for the first column are shown. The voltage pulses VP comprise a first voltage pulse VP1 having an amplitude A1 during a first row selection period RSP1. The voltage pulses VP during the remainder of the first refresh frame period TR1 do not reach the pixel in this first row any more and are shown as having zero amplitude for the pixels in the remainder of the column. So, the pixel P corresponding with the crossing of the first row electrode and the first column electrode receives the first voltage pulse VP1 with amplitude A1 during the first row selection period RSP1, while the remainder of the pixels in the same column are not selected during this first row selection period RSP1 and are receiving voltage pulses of zero volts when selected after the first row selection period RSP1 during the corresponding row selection period for each of these pixels. If in subsequent refresh frame periods the image to be displayed does not change, the voltage pulses VP do not change except for the polarity inversion, resulting in a second voltage pulse VP2 with amplitude −A1 and a third voltage pulse VP3 with amplitude +A1.

FIG. 2B shows the resulting pixel voltage PV of the pixel P as function of time t. Assuming that in a refresh frame period preceding the refresh frame period TR1, the pixel voltage PV was negative, the pixel voltage PV should rise during the first row selection period RSP1 from a level of −A1 to +A1. However, due to the mentioned low pas filter, the pixel voltage PV rises gradually in response to the first voltage pulse VP1. At the end of the first row selection period RSP1 the pixel voltage PV reaches the level A2, which is below the desired level A1, and maintains this value until the next refresh frame period TR2. During the second refresh frame period TR2 the polarity of the second voltage pulse VP2 is reversed, so the pixel voltage PV gradually decreases to a level −A2 during the second voltage pulse VP2. From the third refresh frame period TR3 the cycle of the first and the second refresh frame periods starts to repeat. What can be observed from the resulting pixel voltage PV is that its amplitude does not reach the desired final level of A1, but only the level A2, even if for a number of refresh frame periods the amplitude of the voltage pulses VP does not change (except for the polarity change). As a result the pixels P in the display panel DP do not reproduce the desired brightness.

Moreover, each of the pixels may have slightly different parasitic parameters, resulting in a non-uniform image reproduction, because the pixels do not all reach the same level A2 even when the voltage pulses VP have the same amplitude A1 for all pixels.

In order to overcome this non-uniformity problem, in a first embodiment of the invention the polarity inversion scheme is adapted to drive a pixel of the display panel DP with an adapted drive signal being the drive signal V2 having a first polarity during a first group of refresh frame periods, and being the drive signal V2 with a reversed polarity during a subsequent second group of refresh frame periods, the first group and the second group each comprising at least two refresh frame periods.

An example of such a scheme is shown in FIGS. 2C to 2E. The voltages pulses VP as function of time t form the adapted drive signal that is obtained by applying this polarity inversion scheme to the drive signal V2. As shown in FIG. 2C, a first group of refresh frame periods is formed by refresh frame periods TR1 and TR2. During this first group of refresh frame periods, voltage pulses VP1 and VP2 with a positive amplitude A1 are driving the pixel P. During a second group of refresh frame period formed by TR3 and TR4, voltage pulses VP3 and VP4 with a negative amplitude A1 are driving the pixel. The resulting pixel voltage PV, as shown in FIG. 2D, reaches its desired final level A1 during the second refresh frame period in each group of refresh frame periods. Hence, this polarity inversion scheme enables the pixel voltage PV to reach its final level, which results in a reduction of uniformity errors, even if the refresh frame rate is relatively high. This is particularly relevant if the display panel DP is driven with a sequence of image frames having an image frame period, while the image frames are converted to a drive signal V2 comprising refresh frames with a refresh frame period shorter than the image frame period. The converting of the image frames may be included in the display device DD, or in the signal processing circuitry SPC. Alternatively, the input signal V1 as received may already have the desired format.

In FIG. 2E the pixel brightness PB resulting from the polarity inversion scheme of FIG. 2C is shown. The brightness PB has a level of BA2 corresponding to the level A2 of the pixel voltage PV during the first refresh frame period TR1 and the third refresh frame period TR3. The brightness PB has a level of BA1 corresponding to the level A1 of the pixel voltage PV during the second refresh frame period TR2 and the fourth refresh frame period TR4. The desired brightness is a constant level of BA1, however, as can be seen in FIG. 2E there is some fluctuation between the desired level BA1 and the level BA2 at a rate of half the refresh frame rate. This fluctuation may be reduced by applying a further correction to the drive signal V2, for example, by using a look-up table. This correction may have to be different for each of the refresh frames TR1 to TR4.

Figure 6:
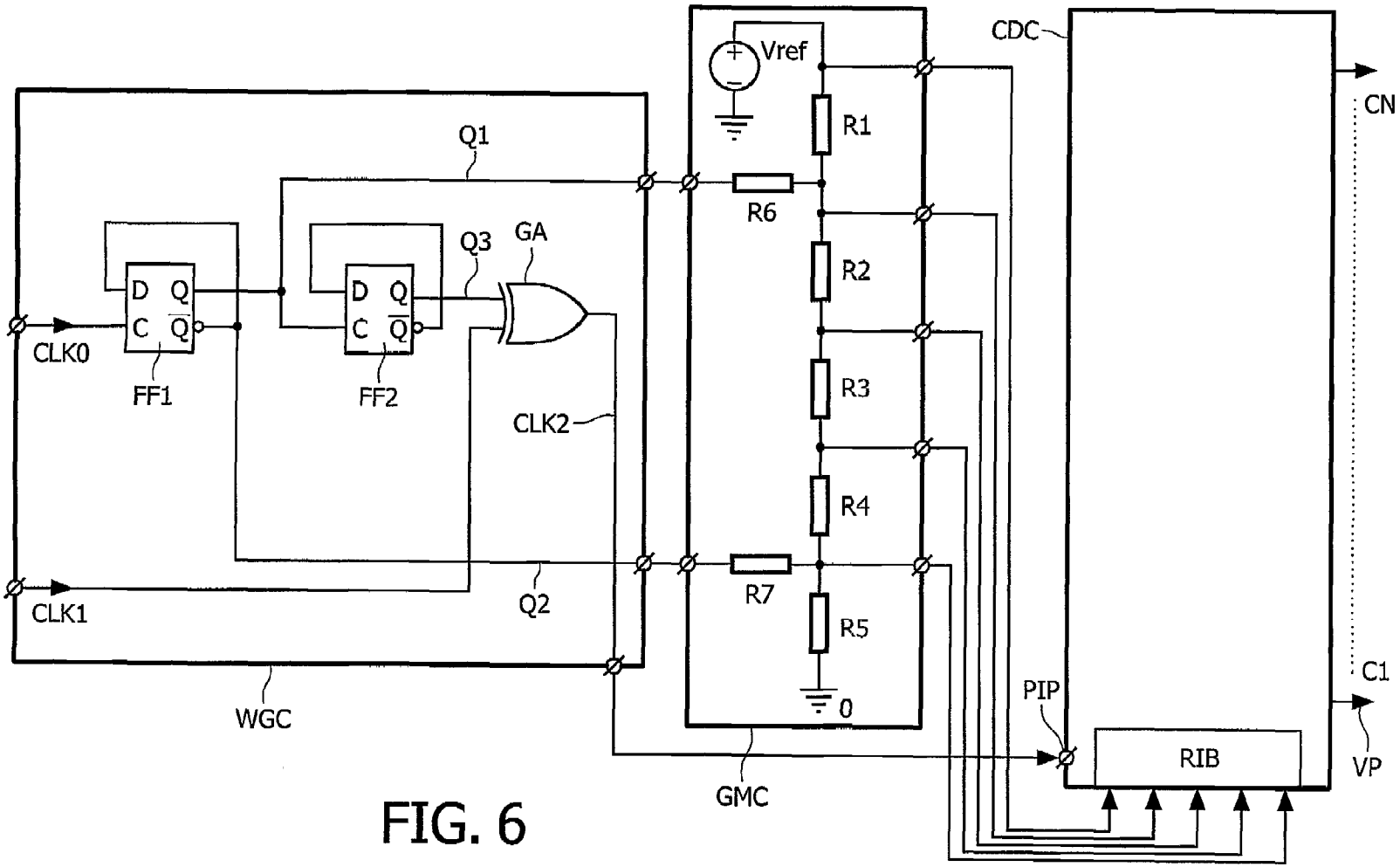
FIG. 6 shows a circuit diagram of a hardware circuit for polarity inversion.
Figure 7:
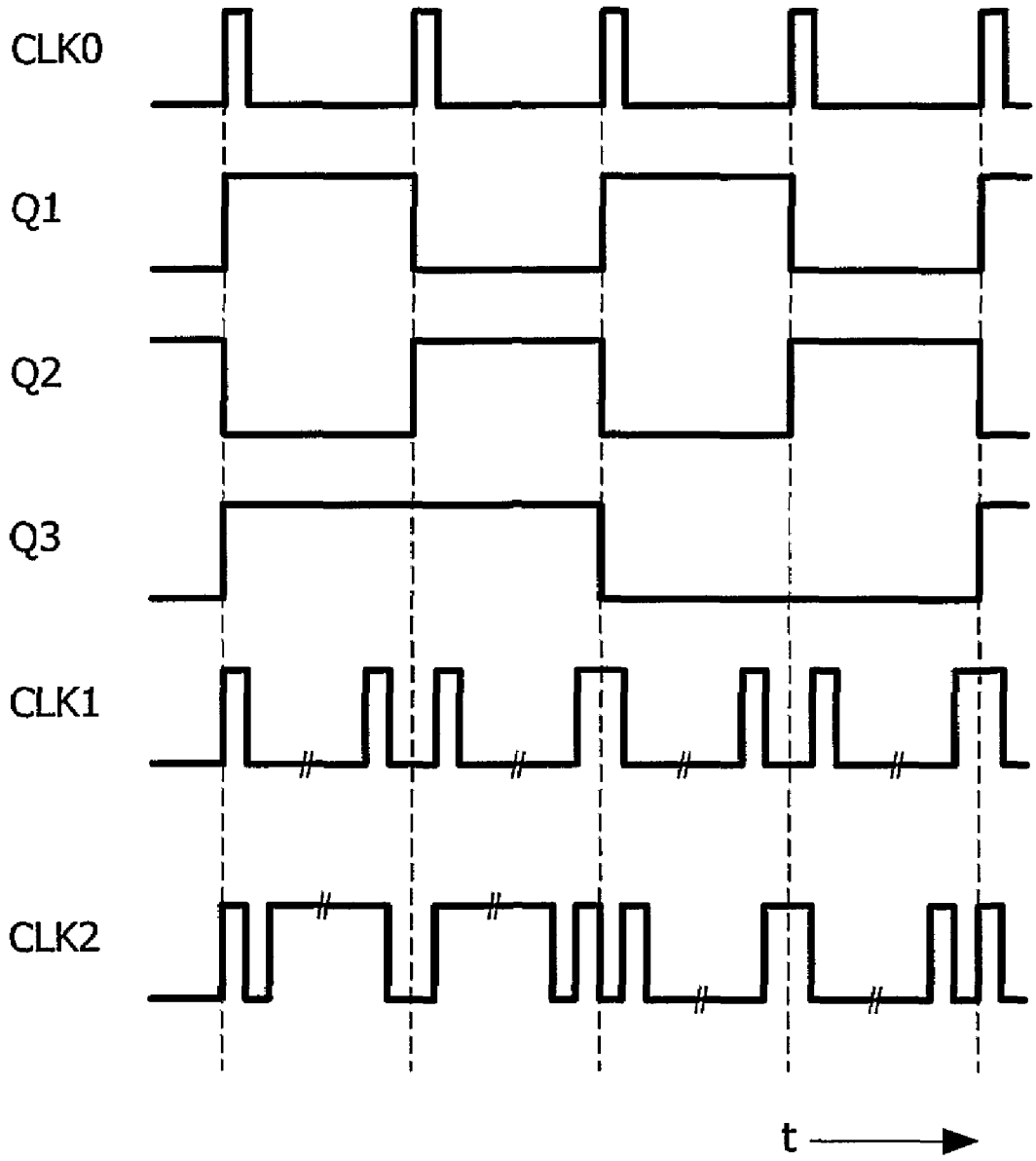
FIG. 7 shows waveforms of signals in the hardware circuit.

In FIG. 6 a circuit diagram of a hardware circuit is shown which performs a similar function as the polarity inversion scheme explained with FIGS. 2C to 2E. FIG. 7 shows waveforms as function of time t of signals in the hardware circuit. The hardware circuit provides a simple and cost effective solution for realizing this inversion scheme.

It comprises a waveform generating circuit WGC for generating waveforms for modulating the voltages pulses VP and for synchronizing this modulation with the polarity inversion scheme. Furthermore, use is made of a group of resistors R1 to R5, which is commonly present on LCD-panels. This group of resistors may also be referred to as "gamma resistors". A gamma modulation circuit GMC comprises these gamma resistors R1 to R5 coupled in series between a first reference voltage Vref and a second reference voltage, which in this example is ground, indicated by "0".

In addition the gamma modulating circuit GMC comprises a sixth resistor R6 coupled to a tap of the first resistor R1 and the second resistor R2, and a seventh resistor R7 coupled to a tap of the fourth resistor R4 and fifth resistor R5. Via these sixth resistor R6 and seventh resistor R7, waveform-modulating signals Q1 and Q2, respectively, are received by the gamma resistors from the waveform generating circuit WGC.

From each of the taps of the gamma resistors R1 to R5 a connection is made to a reference input block RIB of a column driver circuit CDC. The column driver circuit has outputs coupled to the column electrodes C1 to CN. Each output provides a voltage pulse VP to its corresponding electrode C1; . . . CN. The column driver circuit CDC may be formed by one or more integrated circuits, optionally with peripheral components, which together form the vertical driver VEI as shown in FIG. 1 B.

The column driver circuit furthermore has a polarity input port PIP for receiving a polarity synchronizing clock signal CLK2 from the waveform generating circuit WGC. The waveform generating circuit comprises a first D-flip-flop FF1, a second D-flip-flop FF2, and a gate GA.

The waveform generating circuit WGC receives a frame clock signal CLKO and a first frame inversion signal CLK1, which is supplied to a clock input C of the first D-flip-flop FF1.

The first D-flip-flop FF1 is configured as a frequency divider, resulting at its non-inverting output Q in the waveform modulating signal Q1 and its inverting output Q in the waveform modulating signal Q2, which has a polarity opposite to the polarity of the signal Q1. Both signals Q1, Q2 have a repetition rate of half of the frame clock signal CLKO as shown in FIG. 7.

As mentioned before, these waveforms modulating signals Q1, Q2 are supplied to the gamma modulating circuit GMC. In addition the waveform-modulating signal Q1 is coupled to a clock input C of the second D-flip-flop FF2, which is also configured as a frequency divider. As a result, a divided signal Q3 is present at output Q of D-flip-flop FF2. This divided signal Q3 has a repetition rate of ¼th of the frame clock signal CLKO as shown in FIG. 7.

This divided signal Q3 is input to the gate GA together with the first frame inversion signal CLK1. As a result the gate GA provides as output the polarity synchronizing clock signal CLK2, which is similar to the first frame inversion signal CLK1, except that the polarity is reversed with the repetition rate of the divided signal Q3. As mentioned before, the polarity synchronization clock signal CLK2 is supplied to the polarity inversion port PIP of the column driver circuit CDC. In this way the desired polarity inversion scheme is obtained, while in synchronizing with this scheme the waveform modulating signals Q1 and Q2 provide a modulation of the voltages on the taps of the gamma resistors R1 to R5. These voltages are supplied to the reference input block RIB of the column driver circuit for modulating the voltage pulses VP at its output as shown in FIG. 7. The first frame inversion signal CLK1 is a commonly available signal, in the display device DD. It is a signal which not only inverts polarity from frame to frame, but also from line to line. As illustration are shown only the polarity of the first few and the last few lines within each frame.

This modulation of the voltage pulses VP counteracts the variation of the pixel brightness PB as shown in FIG. 2E, resulting from this polarity inversion scheme.

In the example shown in FIG. 2C to FIG. 2E the first group and the second group each consist of two refresh frame periods. Of course, instead of two, each of the groups may also consist of more than two refresh frame periods. Having more than two refresh frame periods in a group has the advantage that more time is available for the pixel voltage PV to reach its final value A1 during subsequent voltage pulses VP. Moreover, the pixel brightness PB, averaged over the first and second group of refresh frame periods, will have an average level closer to the desired value BA1. Preferably, the first group and the second group of refresh frame period each comprise the same number of refresh frame periods in order to minimize any DC component built up in the pixel.

Figures 3A, 3B, 3C, 3D, 3E, 3F:
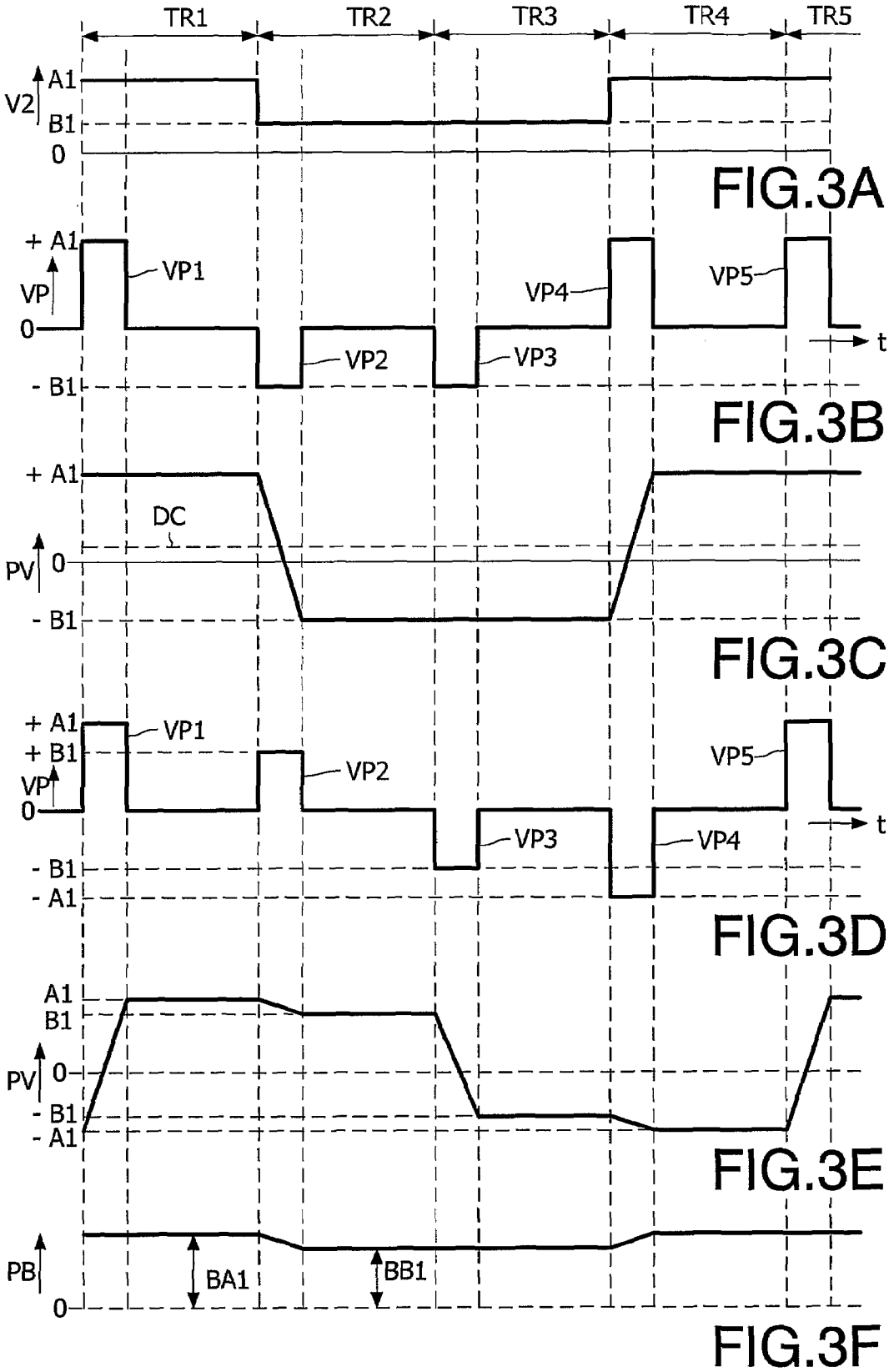
FIGS. 3A to 3C show graphs of the drive voltage, the voltage pulses and the resulting pixel voltage for another polarity inversion scheme.
FIGS. 3D to 3F show graphs of voltage pulses, of a resulting pixel voltage, and of the pixel brightness for a polarity inversion scheme according to a second embodiment of the present invention.

In FIGS. 3A to 3C is shown what happens if the drive signal V2 as function of time t is not completely correct. This may happen, for example, if the drive signal V2 is obtained by a not completely correct de-interlacing of an interlaced input signal V1. This results in a drive signal V2 as shown in FIG. 3A. During the first refresh frame period TR1, for example, the drive signal V2 is obtained from a first de-interlaced image frame (for example derived from an odd image frame) resulting in an amplitude A1. During the second and the third refresh frame periods TR2, TR3, the drive signal V2 is obtained from a second de-interlaced image frame (for example derived from an even image frame) resulting in an amplitude B1. During the fourth and the fifth refresh frame periods TR4, TR5, the drive signal V2 is obtained from a third de-interlaced image frame (for example derived from an odd image frame) resulting in an amplitude A1.

It is further assumed that the input signal V1 is corresponding to a sequence of images of which the brightness of the image to be displayed is supposed to remain constant and that incorrect de-interlacing causes the difference in amplitude between A1 and B1 as shown in FIG. 3A. The resulting voltage pulses VP, based on the polarity inversion scheme of the first embodiment, are shown in FIG. 3B. As in this example the polarity inversion scheme is exactly in phase with the de-interlace error pattern, the positive voltage pulses VP, being VP1, VP4 and VP5 have an amplitude A1, while the negative voltage pulses VP, being VP2 and VP3, have an amplitude B1. As a result, the pixel voltage PV is alternating between a positive amplitude level A1 and a negative amplitude level B1. Due to the difference between the levels A1 and B1, the pixel voltage PV has an undesired DC-component, indicated by "DC" in FIG. 3C.

FIGS. 3D to 3F show a second embodiment of the invention which overcomes above described problem. The phase of the inversion scheme is shifted with respect to the de-interlace pattern. As can be seen in FIG. 3D, a first group of refresh frame periods comprises a first and a second refresh frame which include the voltage pulses VP1 and VP2 having a positive polarity. As the second refresh frame is selected a refresh frame, which is obtained by using data at least partially obtained by converting from an image frame which is different from the image frame of which the first refresh frame is obtained. In this embodiment the second voltage pulse VP2 is included in the second refresh frame. This second voltage pulse VP2 has an amplitude B1 different from the amplitude A1 of the first voltage pulse, as its amplitude B1 is obtained from an image frame which is different from the image frame from which the amplitude A1 of the first voltage pulse VP1 is obtained (see FIG. 3A).

The resulting pixel voltage PV as shown in FIG. 3E has a positive excursion with amplitudes A1 and B1, respectively. Likewise, the negative excursion of the pixel voltage PV during the third and the fourth refresh frame periods TR3, TR4 has amplitudes of B1 and A1, respectively. Averaged over four refresh frame periods the DC component of the pixel voltage PV is zero. So, despite any error-component in the drive signal V2 with the same repetition rate as the repetition rate of the polarity inversion scheme, for example caused by incorrect de-interlacing, there is no DC component present in the pixel voltage PV. Hence, problems caused by the DC component, such as bum-in of stationary logos present in the images, are avoided. The resulting pixel brightness PB is shown in FIG. 3F. The pixel brightness PB follows the fluctuations of the amplitude of the drive signal V2: brightness BA1 corresponds to amplitude A1 and brightness BB1 corresponds to amplitude B1. In order to ensure the correct phase of the polarity inversion scheme with respect to the de-interlace pattern, a field identification signal may be provided by coupling an output from circuitry (or software) for de-interlacing (for example present in the signal processing circuitry SPC) to the driving circuitry D1. An example of such identification signal is also given in FIG. 6, being the synchronizing clock signal CLK2.

Having selected a refresh frame rate TR that is higher than the image frame rate, there is an additional opportunity to simplify the backlight design. If the refresh frame rate is, for example, 100 Hz, while the image frame rate is 50 Hz, the high refresh frame rate allows selecting a duty cycle for driving the lamps of the scanning backlight, which is significantly larger that the earlier mentioned 25%, if the lamps are adapted to provide light pulses LP at the refresh frame rate TR. Compared to a conventional display panel operating at 50 Hz refresh rate, the duty cycle may be increased to 50 %, when operating the display panel DP at 100 Hz refresh rate. In this case the duration of the light pulses LP is in both cases 5 ms, resulting in a comparable image quality as far as motion portrayal is concerned. Depending on ambient conditions, for example, depending on the illumination of the ambient wherein the display panel DP is positioned, and/or the image content, the duty cycle may be increased dynamically even up to 100%. In this case the motion portrayal is still twice as good as in case of a static backlight with a 50 Hz refresh rate, while the backlight is enabled to provide its maximum possible light output.

Figures 4A, 4B, 4C, 4D:
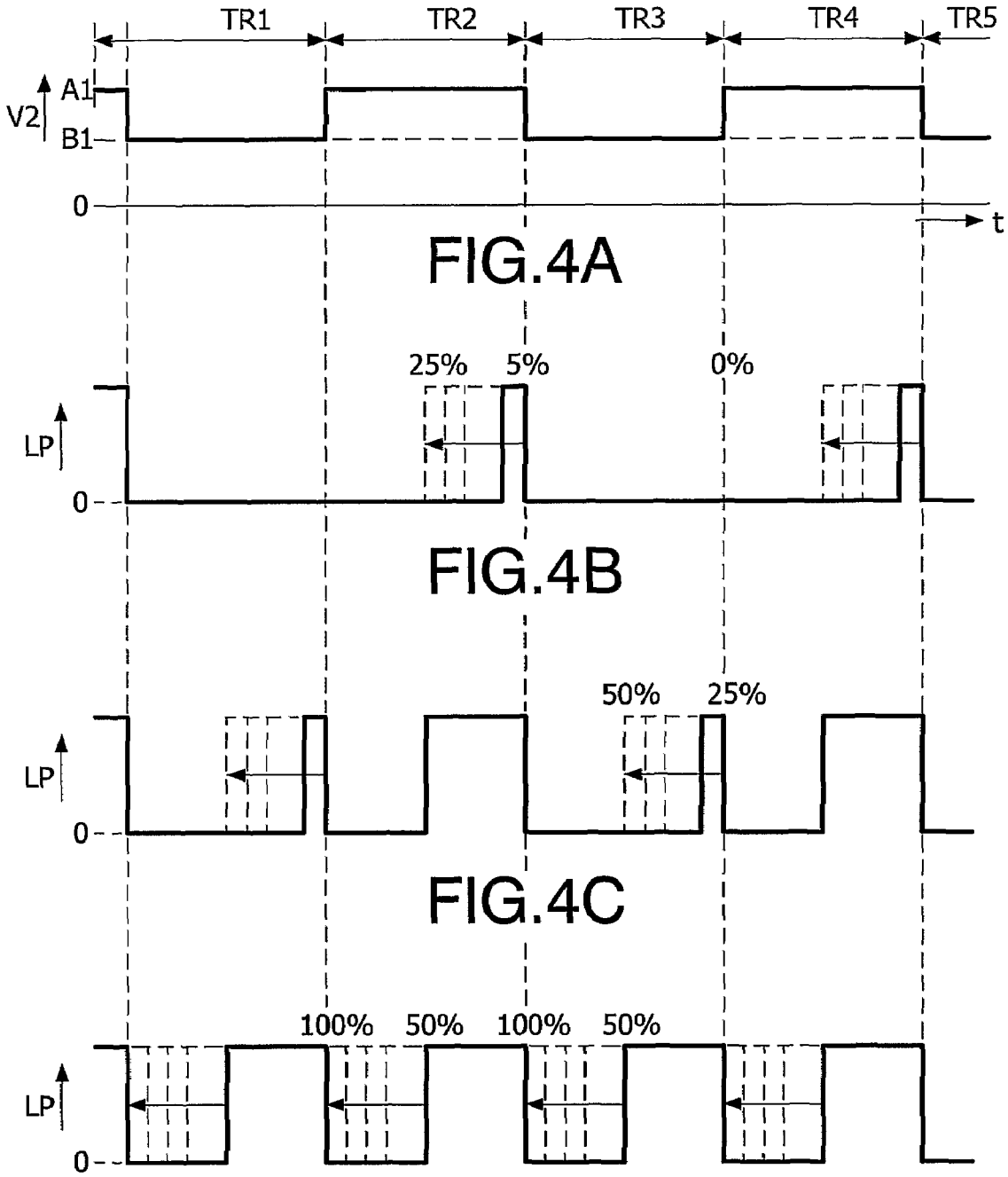
FIGS. 4A to 4D show graphs of the drive voltage, and light pulses for a backlight control scheme according to a third embodiment of the present invention using duty cycle variation.
Figures 5A, 5B, 5C, 5D:
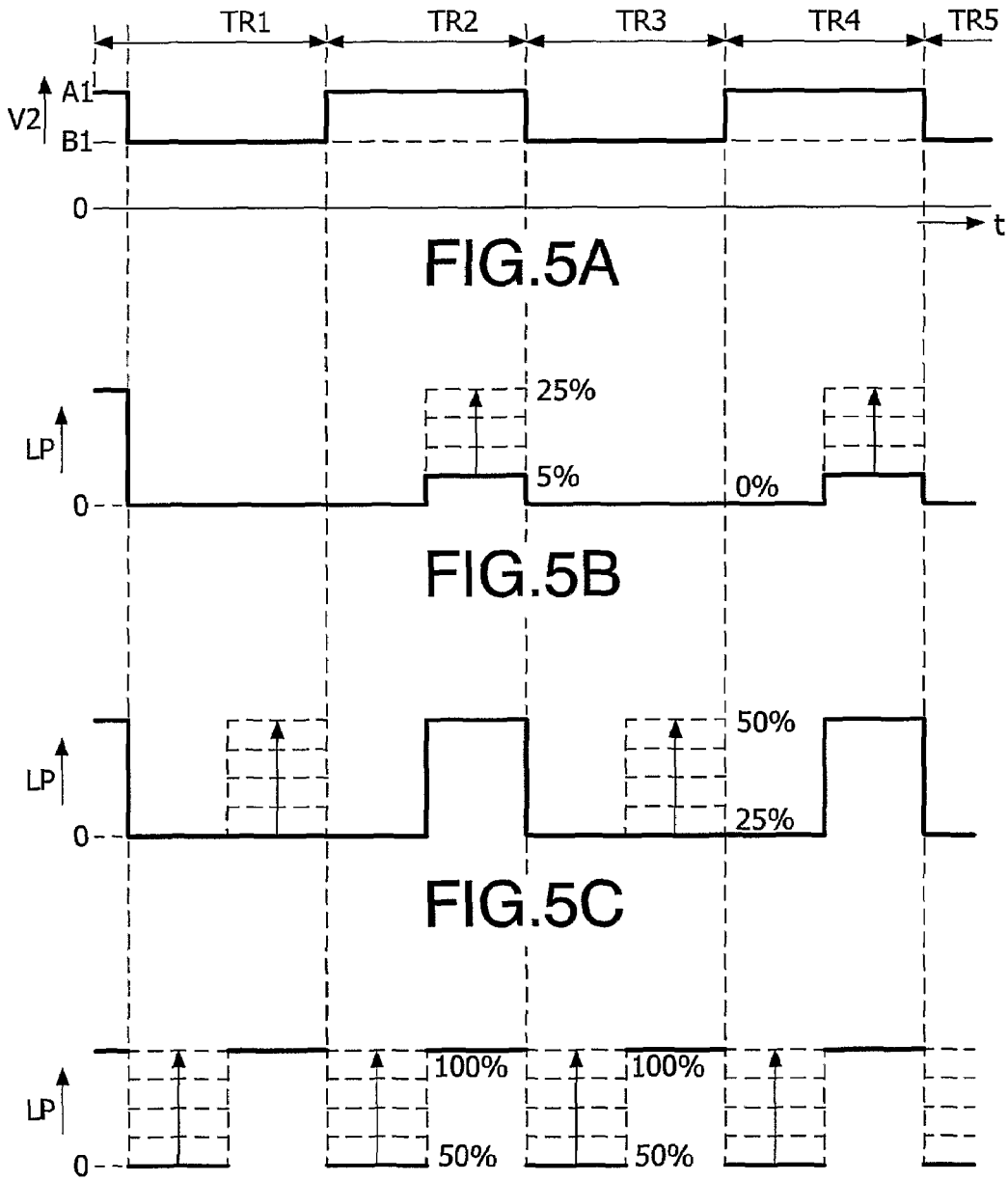
FIGS. 5A to 5D show graphs of the drive voltage, and light pulses for a backlight control scheme according to an alternative of the third embodiment of the present invention using amplitude variation.

Hence, in a third embodiment, which also could be implemented independently of the mentioned polarity inversion schemes, the duty cycle of the light pulses LP is variable in dependence on ambient conditions and/or the content of the image frames. An example of such a backlight control scheme is shown in FIGS. 4A to 4D. FIG. 4A shows an example of the drive signal V2 as function of time t, wherein in subsequent refresh frame periods TR1 to TR5 the drive signal V2 has an amplitude alternating between A1 and B1. It is assumed that the refresh rate is relatively high, for example 100 Hz.

FIG. 4B shows how the duty cycle of light pulses LP may be varied within a refresh frame period TR in case a relatively low light output is desired below a first predetermined value: The duty cycle is varied, for example, from a minimum value 5% up to a maximum of 25% as indicated by arrows. This duty cycle range results in light pulses LP during a fraction of the refresh frame periods TR2 and TR4. During refresh frame periods TR1, TR3, TR5 there are no light pulses LP. If the refresh frame period is 100 Hz, the resulting light pulses LP have a repetition rate of 50 Hz, which at the relatively low light output level does not result in disturbing flicker. Preferably, the refresh frames, selected to receive these light pulses LP, so in this example the frames of refresh frame periods TR2, TR4, are the frames, which provide the best possible image quality of the images to be displayed on the display panel DP. So, if amplitude A1 corresponds to an amplitude of an original image frame and amplitude B1 is obtained by interpolation from one or more image frames, then preferably the frames with amplitude A1 should receive the light pulses LP.

FIG. 4C shows how the duty cycle of the light pulses LP may be increased further in case a light output is desired of an intermediate level between the first predetermined value (corresponding in this example to an effective duty cycle of 25%) and a second predetermined value (corresponding in this example to an effective duty cycle of 50%). The pulse width of the light pulses LP during the refresh frame periods TR2 and TR4 is kept constant, while additional light pulses LP are added during the in-between refresh frame periods TR1, TR3, and TR5. The duration of the additional light pulses LP may now be increased as indicated with arrows, in dependence on the desired light output up to a level corresponding to an effective duty cycle of 50%. At this intermediate level the pulse rate of the light pulses LP equals the refresh rate of 100 Hz, so no flicker is visible and a good motion portrayal is possible, provided the refresh frames for the refresh frame periods TR1, TR3, and TR5 have been obtained by interpolation including motion compensation.

FIG. 4D shows how the duty cycle of light pulses LP may be varied in case a relatively high light output is desired above the second predetermined value: The duration of all light pulses LP may now be increased as indicated with arrows, in dependence on the desired light output up to a level corresponding to an effective duty cycle of 100%. This results at a duty cycle of 100% in the maximum obtainable light output of the lamps of the light source LS. In this situation there is no flicker as the lamps are permanently on, however, motion portrayal is less good.

Summarizing, the embodiment shown in FIG. 4A to 4D shows a backlight control scheme which enables to obtain a best possible reproduction with respect to flicker at various levels of the light output of the light source LS.

Instead of varying the duty cycle, alternatively, or in combination with duty cycle variation, the amplitude of the light pulses LP may be varied as shown in FIGS. 5A to 5D. Below the first predetermined value the amplitude of light pulses LP with a fixed duration is varied during the refresh frame periods TR2, TR4 as shown with arrows in FIG. 5B. When a light output between the first and the second predetermined value is required, the amplitude of the pulses during the refresh frame periods TR2, TR4 is fixed, while the amplitude is varied of pulses with a fixed duration during the refresh frame period TR1, TR3, TR5 as shown with arrows in FIG. 5C. When a light output above the second predetermined level is desired, the light output is varied by varying the amplitude of the pulses present in-between the earlier mentioned pulses with the fixed duration as shown again with arrows in FIG. 5D. The behavior of this backlight control scheme is substantially the same as described for the scheme with duty cycle modulation as shown in FIGS. 4A to 4D.

Preferably, if the light source LS is operating at a relatively low or intermediate level of light output, such as shown in FIGS. 4B, 4C, 5B, 5C, the refresh frames receiving the largest amount of light, so TR2 and TR4, should correspond to the refresh period where the pixel voltage PV has reached is final value as result of the polarity inversion scheme. These are the refresh periods TR2 and TR4, respectively, as shown in FIG. 2D. In this way, the refresh frame periods, wherein the pixel voltage PV has not reached its final value, such as in the refresh periods TR1 and, TR3, do not receive any light pulses LP or relatively small light pulses LP. Hence, these refresh frames with an incorrect amplitude of the pixel voltage PV are not visible or contribute only for a relatively small part to the total light output of the concerned pixel P. So, in this way also the brightness uniformity is improved.

In this application the emphasis is on inversion schemes for a pixel in a display panel DP. Any of these schemes may be executed simultaneously for all pixels in the display panel DP. Alternatively, the schemes may differ per pixel, for example, alternating for subsequent pixels in a line and/or column, alternate per line or per column of pixels, or may alternate in any other manner, for example following a checkerboard pattern.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A method for driving a display panel (DP) having pixels (P) with a sequence of image frames having an image frame period, the method comprising converting the image frames to a drive signal (V2) comprising refresh frames with a refresh frame period (TR) shorter than the image frame period; and driving a pixel (P) of the display panel (DP) with an adapted drive signal being the drive signal (V2) having a first polarity during a first group of refresh frame periods, and being the drive signal (V2) with a reversed polarity during a subsequent second group of refresh frame periods, the first group and the second group each comprising at least two refresh frame periods.

2. A method according to claim 1, wherein the first group of refresh frame periods comprises a first and a second refresh frame, the method comprising selecting as the second refresh frame a refresh frame, which is obtained by using data at least partially obtained by converting from an image frame which is different from the image frame of which the first refresh frame is obtained.

3. A method according to claim 1, the display panel (DP) being adapted for modulating light originating from a light source, which is capable of providing a light pulse (LP) with a duration of a fraction of the refresh frame period (TR), the method further comprising varying the duration and/or an amplitude of the light pulse (LP) in dependence on ambient conditions of the display panel (DP) and/or a content of the image frames.

4. A method according to claim 3, the light source being capable to provide at least a first light pulse (LP) and a second light pulse (LP) during the image frame period, the method further comprising varying the duration and/or the amplitude of one of the first and the second light pulses (LP).

5. A method according to claim 4, the method further comprising varying the duration and/or the amplitude of the first light pulse (LP) during the image frame period, if the duration and/or the amplitude of the second light pulse (LP) has a minimum value.

6. A method according to claim 5, the method further comprising selecting as the first light pulse (LP) a light pulse substantially coinciding with a refresh frame period (TR) within the image frame period, which refresh frame period (TR) provides the best reproduction of the image frame on the display panel (DP).

7. A method according to claim 4, the method further comprising varying the duration and/or the amplitude of the first light pulse (LP) if the light source has to deliver a brightness below a first predetermined value; varying the duration and/or the amplitude of the second light pulse (LP) if the light source has to deliver a brightness between the first predetermined value and a second predetermined value larger than the first predetermined value; and varying the duration and/or the amplitude of the first and the second light pulses (LP) if the light source has to deliver a brightness above the second predetermined value.

8. Driving circuitry (D1) for driving a display panel (DP) having pixels (P) with a sequence of image frames having an image frame period, the driving circuitry comprising converting means for converting the image frames to a drive signal (V2) comprising refresh frames with a refresh frame period (TR) shorter than the image frame period; and driving means for driving a pixel (P) of the display panel (DP) with an adapted drive signal being the drive signal (V2) having a first polarity during a first group of refresh frame periods, and being the drive signal (V2) with a reversed polarity during a subsequent second group of refresh frame periods, the first group and the second group each comprising at least two refresh frame periods.

9. A display device (DD) comprising a display panel (DP) having pixels (P); and the driving circuitry (D1) as claimed in claim 8, the driving circuitry (D1) being coupled to the display panel (DP).

10. A display device according to claim 9, the display panel (PP) comprising at least one column driver circuit (CDC) having a reference input block (RIB) for receiving one or more reference signals, the device further comprising means (WGC, GMC) for generating a waveform (Q1, Q2) for modulating one or more of the reference signals substantially in synchronization with the first and the second group of refresh frame periods.

11. A display device according to claim 10, wherein the means (WGC, GMC) for generating a waveform comprises a D-flip-flop (FF1), having an input for receiving a refresh frame clock signal (CLK0), the D-flip-flop (FF1) being configured for delivering at its output a waveform modulating signal (Q1) having a frequency of half the frequency of the refresh frame clock signal (CLK0).

12. A display device according to claim 11, wherein the means (WGC, GMC) for generating a waveform comprises a further circuit (FF2, GA) for deriving a polarity synchronizing signal (CLK2) from the refresh frame clock signal (CLK0) for synchronizing the first and the second group of refresh frame periods with the waveform (Q1, Q2) for modulating one or more of the reference signals.

13. A display product comprising the display device (DD) of claim 9, and signal processing circuitry (SPC) coupled to the driving circuitry (D1).

* * * * *